US008084571B2

(12) United States Patent
Han et al.

(10) Patent No.: US 8,084,571 B2
(45) Date of Patent: Dec. 27, 2011

(54) AROMATIC POLYAMIDE FILAMENT AND METHOD OF MANUFACTURING THE SAME

(75) Inventors: In-Sik Han, Daegu (KR); Jae-Young Lee, Daegu (KR); Seung-Hwan Lee, Gumi-si (KR); Chang-Bae Lee, Daegu (KR); So-Yeon Kwon, Busan (KR)

(73) Assignee: Kolon Industries, Inc., Kwacheon-si (KR)

( * ) Notice: Subject to any disclaimer, the term of this patent is extended or adjusted under 35 U.S.C. 154(b) by 0 days.

(21) Appl. No.: 12/470,122

(22) Filed: May 21, 2009

(65) Prior Publication Data

US 2009/0253890 A1 Oct. 8, 2009

Related U.S. Application Data

(62) Division of application No. 11/994,643, filed as application No. PCT/KR2006/002625 on Jul. 5, 2006.

(30) Foreign Application Priority Data

Jul. 5, 2005 (KR) ..... 10-2005-0060308

(51) Int. Cl.
*C08G 69/26* (2006.01)

(52) U.S. Cl. ..... 528/332; 528/183; 528/310; 528/337; 528/344; 428/364; 428/395

(58) Field of Classification Search ..... 528/502, 528/348, 183, 337, 344, 310.332; 428/364, 428/395

See application file for complete search history.

(56) References Cited

U.S. PATENT DOCUMENTS

| | | | | |
|---|---|---|---|---|
| 3,869,429 | A | 3/1975 | Blades | |
| 3,869,430 | A | 3/1975 | Blades | |
| 4,885,356 | A | 12/1989 | Milligan et al. | |
| 4,902,774 | A * | 2/1990 | Yang et al. | 528/348 |
| 6,280,843 | B1 * | 8/2001 | Murayama et al. | 428/408 |
| 6,592,987 | B1 * | 7/2003 | Sakamoto et al. | 428/364 |

FOREIGN PATENT DOCUMENTS

| | | |
|---|---|---|
| JP | 2000-54224 A | 2/2000 |
| KR | 1996-17943 A | 6/1996 |

OTHER PUBLICATIONS

Polymer data handbook, pp. 140-157, Oxford University press, 1999.*

* cited by examiner

*Primary Examiner* — James J Seidleck
*Assistant Examiner* — Gregory Liztvoyb
(74) *Attorney, Agent, or Firm* — Birch, Stewart, Kolasch & Birch, LLP

(57) ABSTRACT

Disclosed are wholly aromatic polyamide filament and a method of manufacturing the same, characterized in that, in a process of preparing wholly aromatic polyamide polymer, a multiple tubular feed pipe for polymeric monomer and polymerization solvent with specific construction of adjacent inner paths 11*a* and outer paths 11*b* which are alternately arranged one another is used to feed either aromatic diacid chloride A or aromatic diamine dissolved in the polymerization solvent B into a polymerization reactor 20 through corresponding one among the inner and outer paths 11*a* and 11*b*. The present invention is effective to progress uniform and homogeneous polymerization over all of area of a polymerization reactor 20 leading to reduction of deviation in degree of polymerization, since polymeric monomers are miscible and react together very well immediately after putting the monomers into the reactor 20. Accordingly, the wholly aromatic polyamide filament produced exhibits narrow PDI and increased ACS, so as to considerably improve strength and modulus thereof.

6 Claims, 2 Drawing Sheets

AROMATIC POLYAMIDE FILAMENT AND METHOD OF MANUFACTURING THE SAME

This application is a Divisional of co-pending application Ser. No. 11/994,643 filed on Jan. 3, 2008 and for which priority is claimed under 35 U.S.C. §120. Application Ser. No. 11/994,643 is the national phase of PCT International Application No. PCT/KR2006/002625 filed on Jul. 5, 2006 under 35 U.S.C. §371, which claims priority to KR10-2005-0060308 filed on Jul. 5, 2005. The entire contents of each of the above-identified applications are hereby incorporated by reference.

TECHNICAL FIELD

The present invention relates to wholly aromatic polyamide filament and a method of manufacturing the same, and more particularly, to a method of manufacturing novel wholly aromatic polyamide filament with physical properties including high strength and modulus.

BACKGROUND ART

As disclosed in early known arts, for example, U.S. Pat. Nos. 3,869,429 and 3,869,430, wholly aromatic polyamide filaments are manufactured by a series of processes including: a process of preparing wholly aromatic polyamide polymer by polymerizing aromatic diamine and aromatic diacid chloride in a polymerization solvent containing N-methyl-2-pyrrolidone; a process of preparing a spinning liquid dope by dissolving the prepared polyamide polymer in a concentrated sulfuric acid solvent; a process of forming filaments by extruding the spinning liquid dope through spinnerets and passing the spun material through a non-coagulation fluid layer into a coagulant tank; and a process of refining the resulting filaments by washing, drying and heat treatment processes.

FIG. 1 is a schematic view illustrating a method of manufacturing wholly aromatic polyamide filament by conventional dry-wet spinning process.

As to a conventional process of manufacturing wholly aromatic polyamide filament as illustrated in FIG. 2, since aromatic diacid chloride A as polymeric monomer and a polymerization solvent B containing aromatic diamine as another polymeric monomer are individually introduced into a polymerization reactor 20 through each of corresponding feed pipes 11 which are contiguous with or separated from each other, both of the monomers put into the reactor 20 do not mingle together very well immediately after introducing the monomers, thus, are not polymerized uniformly or homogeneously over all of area of the reactor 20.

For that reason, the conventional process has a disadvantage of increasing deviation in degree of polymerization for wholly aromatic polyamide polymer, thereby causing a problem that physical properties, especially, strength and modulus of wholly aromatic polyamide filament are deteriorated.

As a result of intensive study and investigation made by the present inventor in order to solve the foregoing problem, the present invention has been suggested to produce novel wholly aromatic polyamide filament with improved strength and modulus.

DISCLOSURE OF THE INVENTION

Technical Problem

Therefore, an object of the present invention is to improve strength and modulus of wholly aromatic polyamide filament as a final product by enabling uniform and homogeneous polymerization of monomer over all of area of a polymerization reactor 20, thus, minimizing deviation in degree of polymerization (hereinafter abbreviated to "deviation") of the resulting polymer.

Another object of the present invention is to provide wholly aromatic polyamide filament with noticeably improved modulus and strength which can tolerate external stress by structural alteration that represents narrow distribution of molecular weight of the filament called to Polydispersity Index (referred to as "PDI") and large apparent crystal size (referred to as "ACS"), resulting from minimum deviation of the polymer.

Technical Means to Solve the Problem

In order to achieve the above objects, the present invention provides a process of manufacturing wholly aromatic polyamide filament, comprising: dissolving wholly aromatic polyamide polymer in a concentrated sulfuric acid solvent to prepare a spinning liquid dope, wherein the wholly aromatic polyamide polymer is obtained by polymerizing aromatic diamine and aromatic diacid chloride in a polymerization solvent containing N-methyl-2-pyrrolidone; and spinning the spinning liquid dope through spinnerets to give a spun material, characterized in that, in the process of preparing the wholly aromatic polyamide polymer, a multiple tubular feed pipe 11 for polymeric monomer and polymerization solvent with specific construction of adjacent inner paths 11*a* and outer paths 11*b* which are alternately arranged one another is adapted to feed either aromatic diacid chloride A or aromatic diamine dissolved in the polymerization solvent B into a polymerization reactor 20 through corresponding one among the inner and outer paths 11*a*, 11*b*.

The wholly aromatic polyamide filament of the present invention is characterized in that PDI ranges from 1.5 to 2.3 and apparent crystal size ACS (based on 200 plane) before heat treatment ranges from 42 to 50 Å.

Hereinafter, the present invention will be described in detail with reference to the accompanying drawings.

Firstly, according to the present invention, wholly aromatic polyamide polymer is prepared by polymerizing aromatic diamine and aromatic diacid chloride in a polymerization solvent containing N-methyl-2-pyrrolidone.

The aromatic diamine preferably comprises p-phenylenediamine and the aromatic diacid chloride preferably comprises terephthaloyl chloride.

Also, the polymerization solvent preferably comprises N-methyl-2-pyrrolidone containing dissolved calcium chloride.

As to the process of preparing the wholly aromatic polyamide polymer according to the present invention as described above, either of aromatic diacid chloride A or aromatic diamine dissolved in the polymerization solvent B is fed into the polymerization reactor 20 through each of the inner paths 11*a* and the outer paths 11*b* of the multiple tubular feed pipe 11 for polymeric monomer and polymerization solvent, in which the inner paths 11*a* and the outer paths 11*b* are aligned repeatedly in turns.

The multiple tubular feed pipe 11 is not particularly restricted but includes, for example, double tubular pipe, triple tubular pipe, quadruple tubular and/or quintuple tubular pipe, etc.

FIG. 3 is a schematic view illustrating introduction of polymeric monomer and polymerization solvent into a polymerization reactor by using a double tubular feed pipe 11 for polymeric monomer and polymerization solvent, as a preferred embodiment of the present invention.

Also, FIG. 4 is a cross-sectional view of the double tubular feed pipe 11 as shown in FIG. 3, while FIG. 5 is a cross-sectional view of alternative quadruple tubular feed pipe 11 adaptable for the present invention.

More preferably, aromatic diamine as a polymeric monomer is dissolved in a polymerization solvent and the solution is fed into a polymerization reactor 20 through an outer path 11*b* of the double tubular feed pipe 11 as shown in FIG. 4 while introducing aromatic diacid chloride as another polymeric monomer in an molar amount equal to that of the aromatic diamine through an inner path 11*a* of the above feed pipe 11 into the reactor 20.

As a result, both of the polymeric monomers fed into the reactor 20 are miscible and react each other very well, thus, resulting in uniform and homogeneous polymerization over all of the area of the reactor 20.

Accordingly, the wholly aromatic polyamide polymer produced has minimum deviation leading to narrow PDI and increased ACS, so as to considerably improve strength and modulus of a final product, that is, wholly aromatic polyamide filament.

In order to homogeneously blend the polymeric monomer with the polymerization solvent, it preferably occurs vortex caused by difference in velocity from the moment that the monomer and the solvent pass through the inner path 11*a* and the outer path 11*b*, respectively, or vice versa to allow the monomer to be in contact with the solvent, by regulating a velocity of passing the monomer or the solvent through outlet portion of the inner path 11*a* (referred to as "path outlet velocity") of the feed pipe and the other path outlet velocity of the monomer or the solvent through outlet portion of the outer path 11*b* of the feed pipe such that both of the velocities are different from each other.

The multiple tubular feed pipe 11 for polymeric monomer and polymerization solvent preferably has circular, elliptical or polygonal cross-section.

Furthermore, the monomer and the polymerization solvent fed into the polymerization reactor 20 are preferably agitated to be homogeneously blended together by using an agitator equipped in the reactor 20.

The wholly aromatic polyamide polymer has intrinsic viscosity of not less than 5.0, which is preferable for improving the strength and modulus of the filament.

Conditions of polymerization for the above polymer are substantially same as those previously known, for example, in U.S. Pat. No. 3,869,429 or the like.

A preferred embodiment of the process for preparing the above polymer provides microfine powder form of polymer by introducing a solution which is obtainable by dissolving 1 mole of p-phenylenediamine in N-methyl-2-pyrrolidone containing above 1 mole of calcium chloride, and 1 mole of terephthaloyl chloride into the polymerization reactor 20 through the double tubular feed pipe 11 according to the present invention; agitating the mixture in the reactor to form a gel type of polymer; and crushing, washing and drying the gel type polymer, thereby resulting in the polymer in the microfine powder form. The terephthaloyl chloride may be introduced into the reactor 20 in halves and/or by two steps.

Next, the wholly aromatic polyamide polymer prepared as described above is dissolved in a concentrated sulfuric acid solvent to form a spinning liquid dope. Then, as shown in FIG. 1, the spinning liquid dope is submitted to a spinning process through a spinneret 40 to form spun material, followed by passing the spun material through a non-coagulation fluid layer into a coagulant tank 50 to form filaments. In the end, wholly aromatic polyamide filament according to the present invention is produced by washing, drying and heat treatment processes for the resulting filament. FIG. 1 is a schematic view illustrating a process of manufacturing wholly aromatic polyamide filament by a dry-wet spinning process.

The concentrated sulfuric acid used in production of the spinning liquid dope preferably has a concentration ranging from 97 to 100% and may be replaced by chlorosulfuric acid or fluorosulfuric acid.

If the concentration of the sulfuric acid is below 97%, solubility of the polymer is lowered and non-isotropic solution cannot easily express liquid crystallinity. Therefore, it is difficult to obtain the spinning liquid dope with a constant viscosity, and in turn, to manage the spinning process, thus causing mechanical properties of a final textile product to be deteriorated.

Otherwise, when the concentration of the concentrated sulfuric acid exceeds 100%, SO3 content becomes excessive in any fumed sulfuric acid containing over-dissociated SO3, thus, it is undesirable to handle and use the sulfuric acid as the spinning liquid dope because it causes partial dissolution of the polymer. In addition, even if the fiber is obtainable by using the spinning liquid dope, it has loose inner structure, is substantially lusterless in terms of appearance and decreases diffusion rate of the sulfuric acid into the coagulant solution, so that it may cause a problem of lowering mechanical properties of the fiber.

Alternatively, the concentration of polymer in the spinning liquid dope preferably ranges from 10 to 25% by weight.

However, both of the concentration of the concentrated sulfuric acid and the concentration of the polymer in the spinning liquid dope are not particularly limited.

The non-coagulation fluid layer may generally comprise an air layer or an inert gas layer.

Depth of the non-coagulation fluid layer, that is, a distance from the bottom of the spinneret 40 to the surface of the coagulant in the coagulant tank 50 preferably ranges from 0.1 to 15 cm, in order to improve spinning ability or physical properties of the filament.

The coagulant contained in the coagulant tank 50 may overflow and include but be not limited to, for example, water, saline or aqueous sulfuric acid solution with below 70% of concentration.

Subsequently, the formed filament is subject to washing, drying and heat treatment to manufacture wholly aromatic polyamide.

The spinning and take-up velocity ranges from 700 to 1,500 m/min.

The resulting wholly aromatic polyamide according to the present invention has minimum deviation, thus, exhibits narrow PDI and large apparent crystal size ACS, so that it has excellent strength before and after the heat treatment of not less than 26 g/d, and excellent modulus before the heat treatment of not less than 750 g/d and after the heat treatment of not less than 950 g/d.

More particularly, the wholly aromatic polyamide filament according to the present invention has PDI ranging from 1.5 to 2.3, preferably, 1.5 to 2.0, and more preferably, 1.5 to 1.7, and the apparent crystal size ACS (based on 200 plane) before the heat treatment ranging from 42 to 50 Å, and more preferably, 47 to 50 Å.

Also, the apparent crystal size ACS (based on 200 plane) ranges from 46 to 55 Å, and more preferably, 53 to 55 Å after the heat treatment at 300° C. under 2% tension for 2 seconds.

In case that PDI exceeds the above range or the apparent crystal size ACS is less than the above range, it shows insignificant increase of the modulus. On the contrary, the apparent crystal size ACS exceeds the above range, the strength is reduced while the modulus increases.

Also, in case that PDI is less than the above range, although the modulus increases it is within an area which is difficult to be achieved by the present invention.

Accordingly, compared with conventional wholly aromatic polyamide filament, the wholly aromatic polyamide filament of the present invention has minimum deviation in degree of polymerization of the polymer, thus, represents narrow PDI and larger ACS before and after the heat treatment.

As a result, the wholly aromatic polyamide exhibits excellent strength and remarkably improved modulus.

Advantageous Effects

As described above, the present invention enables deviation in degree of polymerization to be minimum by uniformly progressing polymerization of polymeric monomer over all of area of the polymerization reactor 20.

Accordingly, the wholly aromatic polyamide filament manufactured by the present invention has minimum deviation in degree of polymerization of the polymer, thus, represents narrow PDI and larger ACS so that it exhibits excellent strength and remarkably improved modulus.

BRIEF DESCRIPTION OF THE DRAWINGS

The above object, features and advantages of the present invention will become more apparent to those skilled in the related art from the following preferred embodiments of the invention in conjunction with the accompanying drawing.

Figure 1:
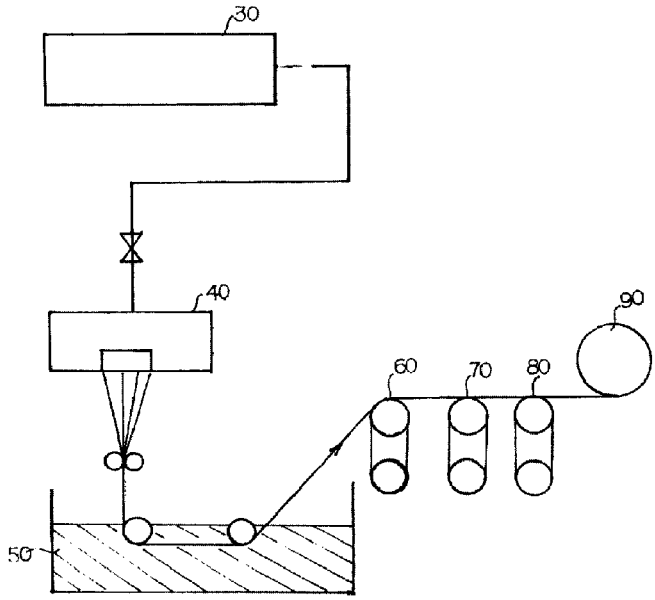
FIG. 1 is a schematic view illustrating a process of manufacturing wholly aromatic polyamide filament by conventional dry-wet spinning process.
Figure 2:
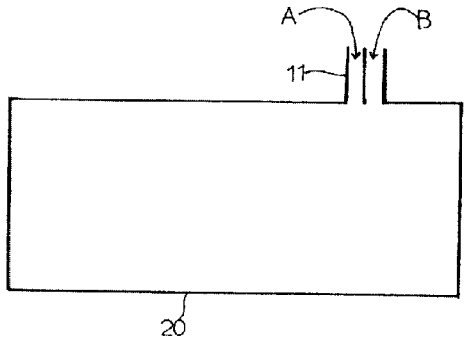
FIG. 2 is a schematic view illustrating introduction of polymeric monomer and polymerization solvent into a polymerization reactor according to conventional process.

* Explanation of Reference Numerals of Main Parts of the Drawings

| | |
|---|---|
| 11: | feed pipe for polymeric monomer and polymerization solvent |
| 11a: | inner path of feed pipe |
| 11b: | outer path of feed pipe |
| 20: | polymerization reactor |
| 30: | spinning liquid dope storage tank |
| 40: | spinneret |
| 50: | coagulant tank |
| 60: | washing device |
| 70: | dryer |
| 80: | heat treatment device |
| 90: | winder |
| A: | aromatic diacid chloride |
| B: | aromatic diamine dissolved in polymerization solvent |

BEST MODE FOR CARRYING OUT THE INVENTION

Features of the present invention described above and other advantages will be more clearly understood by the following non-limited examples and comparative examples. However, it will be obvious to those skilled in the art that the present invention is not restricted to the specific matters stated in the examples below.

Example 1

1,000 kg of N-methyl-2-pyrrolidone was maintained at 80° C. and combined with 80 kg of calcium chloride and 48.67 kg of p-phenylenediamine which was then dissolved to prepare an aromatic diamine solution B.

Figure 3:
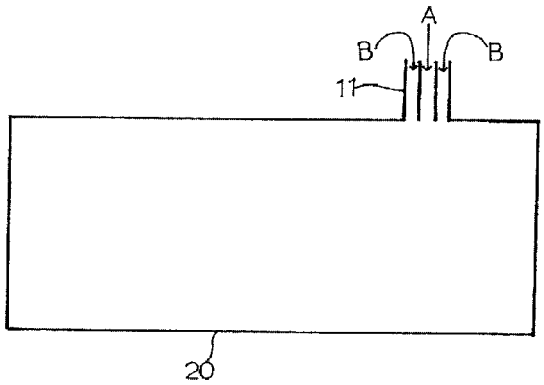
FIG. 3 is a schematic view illustrating introduction of polymeric monomer and polymerization solvent into a polymerization reactor by using a double tubular feed pipe 11 for polymeric monomer and polymerization solvent according to the present invention.
Figure 4:
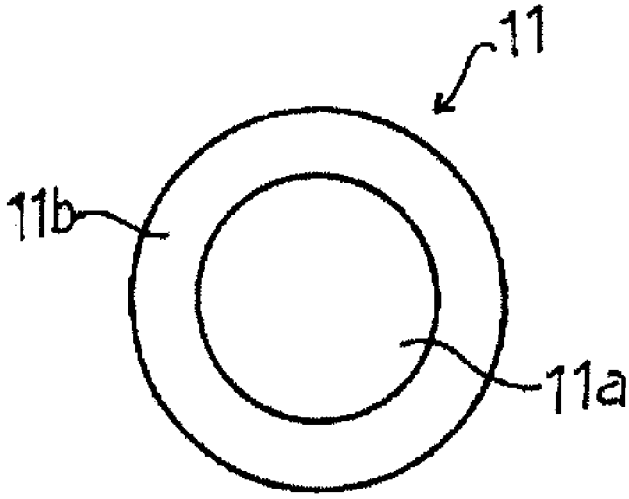
FIG. 4 is a cross-sectional view of the double tubular feed pipe 11 according to the present invention, as shown in FIG. 3.
Figure 5:
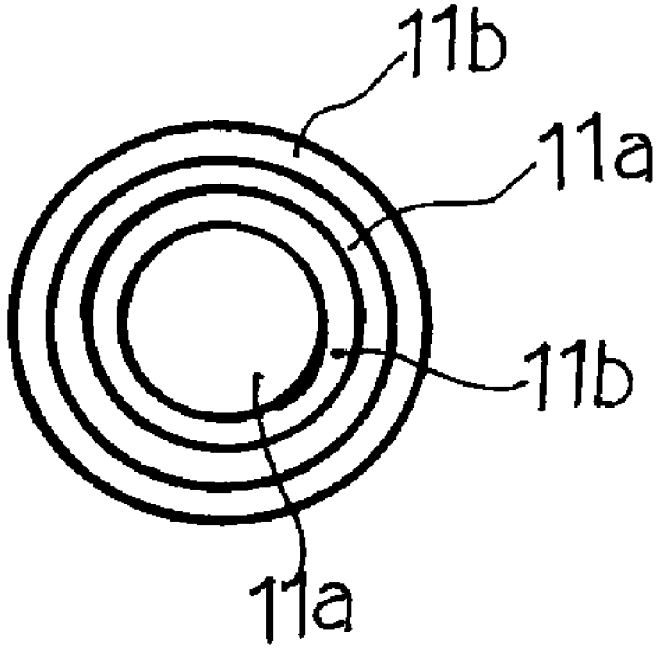
FIG. 5 is a cross-sectional view of a quadruple tubular feed pipe 11 according to other embodiment of the present invention.

After putting the aromatic diamine solution B into a polymerization reactor 20 through an outer path 11*b* of a double tubular feed pipe 11 as illustrated in FIG. 3, and fused terephthaloyl chloride A in a molar quantity equal to p-phenylenediamine simultaneously into the reactor 20 through an inner path 11*a* of the feed pipe 11, both of these compounds were agitated and became poly(p-phenylene terephthalamide) polymer with intrinsic viscosity of 6.8.

Continuously, the obtained polymer was dissolved in 99% concentrated sulfuric acid to form an optical non-isotropic liquid dope for spinning with 18% of polymer content.

The formed liquid dope was spun through the spinneret 40 as shown in FIG. 1 to form spun material. After passing the spun material through an air layer with thickness of 7 mm, it was fed into a coagulant tank 50 containing water as the coagulant, thereby forming filament.

After that, to the formed filament, water was injected at 25° C. to rinse the filament, followed by passing the filament through a double-stage dry roller having the surface temperature of 150° C. and winding the rolled filament to result in poly (p-phenylene terephthalamide) filament before heat treatment.

Various physical properties of the produced poly(p-phenylene terephthalamide) filament were determined and the results are shown in the following Table 1.

Example 2

The poly(p-phenylene terephthalamide) filament resulting from Example 1 was subject to heat treatment at 300° C. under 2% tension for 2 seconds to yield a final product, that is, poly(p-phenylene terephthalamide) filament after heat treatment.

Various physical properties of the produced poly(p-phenylene terephthalamide) filament were determined and the results are shown in the following Table 1.

Comparative Example 1

The production of poly(p-phenylene terephthalamide) filament before heat treatment was carried out in the same procedure and under similar conditions as Example 1 except that the aromatic diamine solution B and the fused terephthaloyl chloride A prepared in Example 1 were separately fed into the polymerization reactor through corresponding feed pipes, respectively.

Various physical properties of the produced poly(p-phenylene terephthalamide) filament were determined and the results are shown in the following Table 1.

Comparative Example 2

The poly(p-phenylene terephthalamide) filament resulting from Comparative Example 1 was subject to heat treatment at 300° C. under 2% tension for 2 seconds to yield a final product, that is, poly(p-phenylene terephthalamide) filament after heat treatment.

Various physical properties of the produced poly(p-phenylene terephthalamide) filament were determined and the results are shown in the following Table 1.

TABLE 1

Evaluation results of physical properties of filament

| Section | | Example 1 | Example 2 | Comparative example 1 | Comparative example 2 |
|---|---|---|---|---|---|
| Polydispersity index (PDI) | | 1.7 | 1.6 | 2.6 | 2.5 |
| Apparent crystal size (ACS; based on 200 plane) | Before heat treatment | 47 Å | — | 45 Å | — |
| | After heat treatment at 300° C. under 2% tensile for 2 seconds | — | 54 Å | — | 51 Å |
| Strength (g/d) | | 27 | 26 | 22 | 21 |
| Modulus (g/d) | | 830 | 1,080 | 730 | 930 |

The foregoing listed physical properties of the filament according to the present invention were determined and/or evaluated by the following procedures:

Strength (g/d):

After measuring force g at break point of a sample yarn by means of Instron tester which is available from Instron Engineering Corp., Canton, Mass., using the sample yarn with 25 cm of length, the measured value was divided by denier number of the sample yarn to give the strength. Such strength is the average calculated from values yielded by testing the sample yarns five times. In this examination, the tension velocity was defined as 300 mm/min and the initial-load was defined as fineness×1/30 g.

Modulus (g/d):

Under the same conditions as with the strength, a stress-strain curve for the sample yarn was obtained. The modulus was determined from a slope of the stress-strain curve.

Polydispersity Index PDI:

Using Gel Permeation Chromatography (referred to as "GPC"), PDI was determined by the following procedures:

(i) Synthesis of Wholly Aromatic Polyamide Polymer Derivative

Wholly aromatic polyamide filament as a sample and potassium ter-butoxide were added to dimethyl sulfoxide and dissolved at room temperature under nitrogen atmosphere. Then, to the solution, added was allyl bromide to produce wholly polyamide polymer substituted by allyl group (see Macromolecules 2000, 33, 4390).

(ii) Determination of PDI

The produced wholly polyamide polymer was dissolved in $CHCl_3$ and submitted to determination of PDI by using Shodex GPC of Waters manual injector kit at 35° C. and a flow rate of 1.0 ml/min, which is equipped with a refraction index detector.

Apparent Crystal Size ACS:

Using Rigaku X-ray Diffractometer (referred to as "XRD"), ACS was determined by the following procedures:

(i) Sampling

Wholly aromatic polyamide filament samples having a thickness of about 1,000 to 2,000 deniers were aligned as regularly as possible, and then fixed to a sample holder with a length of 2 to 3 cm.

(ii) Measurement Order

After fixing the prepared sample on a sample attachment, β-position is set up to 0° (the sample is fixed on the sample attachment in an axial direction of the filament to set up β-position).

XRD equipment is ready to measure ACS by gently raising electric voltage and current up to 50 kV and 180 mA, respectively, after warming-up the equipment.

Equatorial pattern capable of calculating ACS is measured.

Set up are the following measurement conditions in principle:

Goniometer, continuous scan mode, scan angle range of 10 to 40°, and scan speed of 2.

Measured are 2θ positions of two peaks appearing between the range of 20 to 21° and 22 to 23° of a profile in which the scanning was carried out.

The measured profile is subject to operation of Multi-peak separation method program.

After defining Background straightly from 2θ 15 to 35° and separating two crystal peaks, ACS is calculated by means of Scherrer equation using factors [2θ position, intensity, full-width at half-maximums (FWHM)] when K of every crystal face is 1. Such ACS means average size of crystals in every face.

INDUSTRIAL APPLICABILITY

As described above, the present invention is effective to manufacture wholly aromatic polyamide filament with excellent strength and modulus.

What is claimed is:

1. Wholly aromatic polyamide filament, characterized in that polydispersity index PDI ranges from 1.5 to 2.3 and apparent crystal size ACS (based on 200 plane) before heat treatment ranges from 42 to 50 Å, wherein the PDI is measured by gel permeation chromatography (GPC) at 35° C., and wherein the wholly aromatic polyamide polymer has an intrinsic viscosity of not less than 5.0.

2. The filament according to claim 1, wherein polydispersity index PDI ranges from 1.5 to 2.0.

3. The filament according to claim 1, wherein polydispersity index PDI ranges from 1.5 to 1.7.

4. The filament according to claim 1, wherein apparent crystal size ACS (based on 200 plane) after heat treatment at 300° C. under 2% tension for 2 seconds ranges from 46 to 55 Å.

5. The filament according to claim 1, wherein the apparent crystal size ACS (based on 200 plane) before heat treatment ranges from 47 to 50 Å.

6. The filament according to claim 4, wherein apparent crystal size ACS (based on 200 plane) after heat treatment at 300° C. under 2% tension for 2 seconds ranges from 53 to 55 Å.

* * * * *